United States Patent [19]

Catallo

[11] 4,074,901

[45] Feb. 21, 1978

[54] FOLDER FOR WEB MATERIALS

[76] Inventor: Frank Catallo, 84 Wheatley Road, Old Westbury, N.Y. 11568

[21] Appl. No.: 783,171

[22] Filed: Mar. 31, 1977

[51] Int. Cl.[2] ..... B65H 45/20

[52] U.S. Cl. ..... 270/79

[58] Field of Search ..... 270/79, 61 F, 30–31

[56] References Cited

U.S. PATENT DOCUMENTS

| | | | |
|---|---|---|---|
| 3,165,311 | 1/1965 | Mitchell | 270/79 |
| 3,523,473 | 8/1970 | Norcross | 270/30 |
| 3,790,156 | 2/1974 | Hogendyk | 270/79 |

*Primary Examiner*—Edgar S. Burr

*Assistant Examiner*—A. Heinz

*Attorney, Agent, or Firm*—Thomas E. Tate

[57] ABSTRACT

The disclosure is that of an invention directed to a folder for a continuously advancing web of a textile material in which a pair of horizontal spaced parallel transverse guide rolls are operably supported by a pair of inwardly opposed horizontal C-beams and are adapted to be independently driven in the same opposite directions by alternating contacts with the upper and lower flanges of the C-beams as the guide rolls are bodily reciprocably traversed along the C-beams by rock yoke and slide connections extending between the shafts of the guide rolls and pivots carried by a pair of continuously driven endless traversing chains.

5 Claims, 4 Drawing Figures

FOLDER FOR WEB MATERIALS

THE INVENTION

Figure 1:
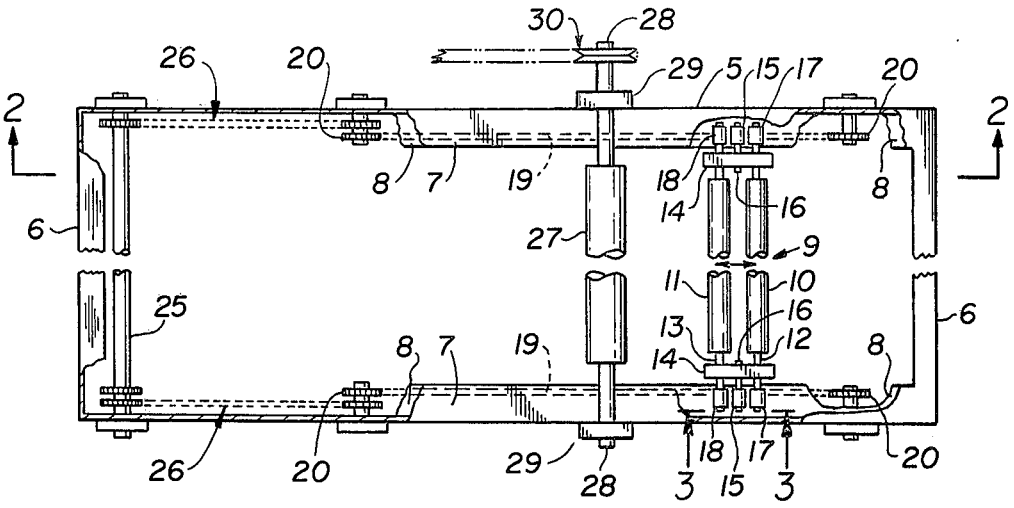

This invention relates generally to new and useful improvements in apparatus for folding web materials and particularly seeks to provide a novel machine for zig-zag or fan folding a continuously advancing textile web of either woven or knitted construction.

Heretofore, most folders for this purpose have been either of the type employing a guide roll mounted on an oscillating frame overlying a table or other receptacle upon or into which the web is folded, or of the type employing a spaced pair of guide rolls that are adapted to be bodily reciprocated by endless chain drives.

As an example of the latter type of folder, U.S. Pat. No. 3,534,952, granted Oct. 20, 1970, discloses a folder that requires the use of clutch-controlled alternating chain drives, over-running sheaves and gear connections with respect to a horizontally reciprocable or traversable pair or guide rolls in order to keep them rotating in the same opposite direction regardless of the direction of traverse and in order to keep both of them continuously supported upon side rails for friction drive relation thereto.

As another example of the latter type of folder, U.S. Pat. No. 2,761,678, granted Sept. 4, 1956, discloses a folder in which a pair of gear-connected guide rolls are supported upon side rails and are bodily reciprocated by pivotal connection to an endless chain. In that folder it is necessary that one or the other of the guide rolls be lifted from its engagement with the side rails during each stroke of reciprocation in order to avoid a locked or inoperative condition as the result of the gearing connections between the rolls.

In contrast, a folder constructed in accordance with this invention eliminates the alternating clutch drives, over-running sheaves and the gear connections between the guide rolls of the above mentioned U.S. Pat. No. 3,534,952; and, also, not only eliminates the necessity for the gear connections between the guide rolls of the above mentioned U.S. Pat. No. 2,761,678 but provides means for independently frictionally driving both of the guide rolls in the same opposite directions regardless of their direction of bodily traverse.

In general, this result is accomplished by mounting the shafts of the guide rolls on end rollers that freely ride with limited clearance between the upper and lower flanges of two pairs of inwardly opposed frame members that are the equivalent of C-beams and bodily traversing the guide rolls by rock yoke, slide and pivotal connections to an endless drive chain so that in one direction of traverse the end rollers of one guide roll will be driven by frictional contact with the upper flanges of the opposed C-beams and the end rollers of the other guide roll will be driven by frictional contact with the lower flanges of the opposed C-beams and in the opposite direction of traverse, the end rollers of the guide rolls will be shifted into driven engagement with the opposite flanges of the C-beams. A modification of the well known "Scotch Yoke" mechanical movement is used to connect the guide roll assembly to the endless drive chains and to effect the above mentioned shifting of the end rollers at the end of each stroke of reciprocation or traverse of the guide roll assembly.

Therefore, an object of this invention is to provide a novel folder constructed and operated in accordance with the general description set forth in the immediately preceding paragraph and in which a continuously advancing web of textile material is fed over an upper horizontal draw roll and downwardly between a pair of horizontal, frictionally driven, guide rolls that are bodily reciprocated or traversed by operable connections to a constantly driven endless chain.

Another object of this invention is to provide a folder of the character stated that is simple in design, rugged in construction and economical to manufacture.

With these and other objects, the nature of which will become apparent, the invention will be more fully understood by reference to the drawings, the accompanying detailed description and the appended claims.

Figure 2:
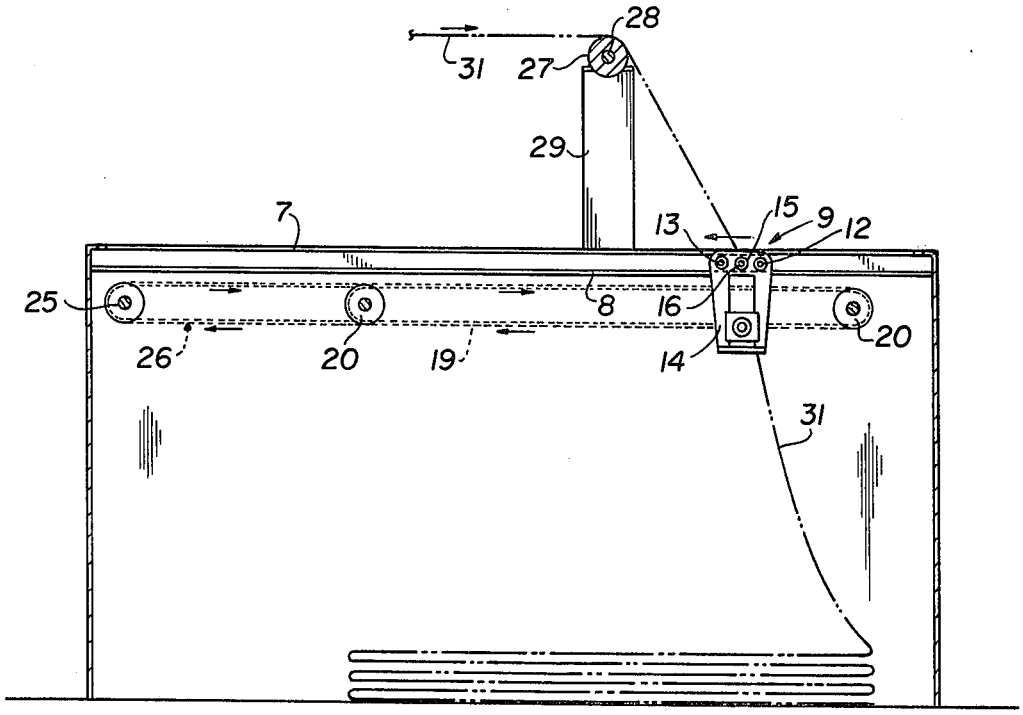
Figure 3:
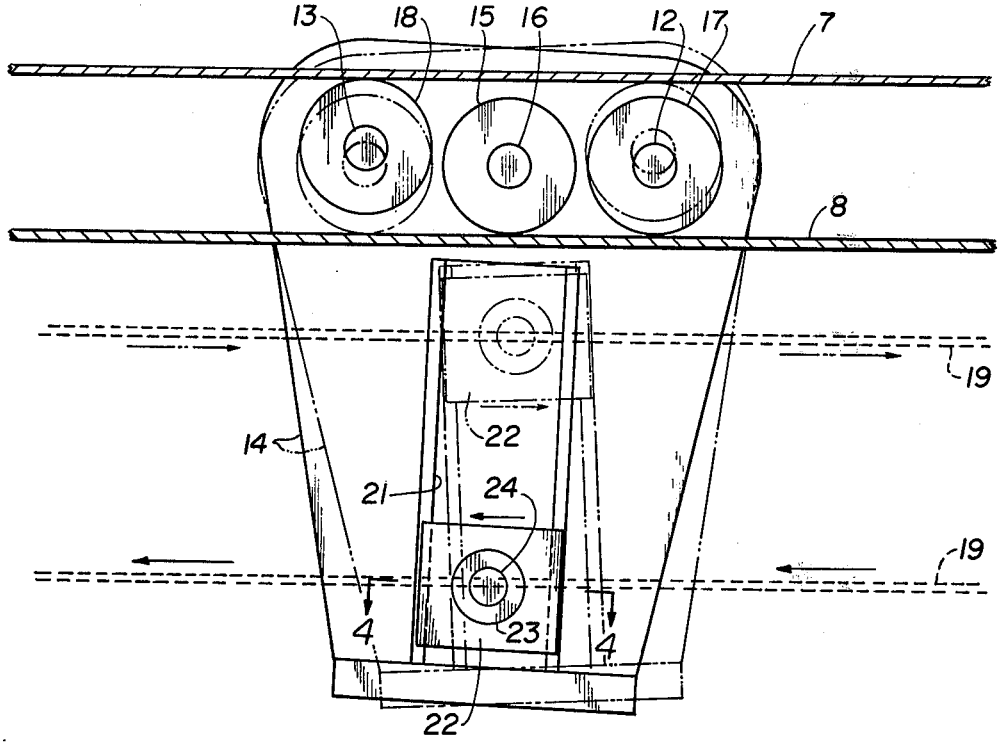
Figure 4:
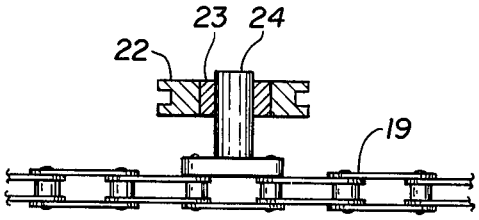

In the drawings:

FIG. 1 is a top plan view of a folder constructed in accordance with this invention;

FIG. 2. is a vertical longitudinal section taken along line 2—2 of FIG. 1;

FIG. 3 is an enlarged detail longitudinal section taken along line 3—3 of FIG. 1 and shows the rock yoke mounting for the guide rolls of the traversing assembly; and FIG. 4 is a horizontal detail section taken along line 4—4 of FIG. 3 and shows the pivotal connection between one of the endless traversing chains and the slide roller of its associated rock yoke.

Referring to the drawings in detail the invention, as illustrated, is embodied in a machine for zig-zag or fan folding a continuously advancing web of textile material and includes the usual side frames 5,5 and end frames 6,6.

The side frames 5,5 are provided with a pair of inwardly opposed horizontal upper flanges or tracks 7,7 and a pair of inwardly opposed lower flanges or tracks 8,8 disposed in spaced parallel relation with respect to the upper flanges and may be vertically adjustable in order to vary the spacing. Thus, the upper and lower flanges may be considered as equivalent to the flanges of an opposed pair of C-beams that serve as supports for a reciprocable or traversable guide roll assembly as will be hereinafter more fully described.

A transverse guide roll assembly generally indicated 9 is operably supported by the lower flanges or tracks 8 for reciprocable traverse along a substantial portion of the length of the machine and includes a pair of spaced parallel guide rolls 10 and 11 affixed to shafts 12 and 13 that are journalled at each end in a rock yoke 14 that is pivotably and rollably supported on its associated lower flange or track 8 by an upper centrally located roller 15 mounted on a stub axle 16 affixed to the rock yoke.

Each end of the shaft 12 is provided with a roller 17 affixed thereto and located between the upper and lower flanges or tracks 7 and 8 for alternating friction drive contact therewith as will be hereinafter more fully described. The axis of the shaft 12 lies in a plane slightly above that of the pivot or stub axle 16 and the diameter of the roller 17 is such as to provide a top and bottom clearance of about 1/32 inch between its periphery and the adjacent surfaces of the flanges or tracks 7 and 8.

Similarly, each end of the shaft 13 is provided with a roller 18 for alternating friction drive contact with the upper and lower flanges or tracks 7 and 8 and the axis of the shaft 13 lies in the same plane as that of the shaft 12 when the yoke is in a vertical dead center position.

Thus, when the median axis of the rock yoke 14 is vertical, the axes of the shafts 12 and 13 will lie in a horizontal plane slightly above that of the stub axle 16 and neither of the rollers 17 or 18 will be in contact with either of the upper and lower flanges or tracks 7 and 8 because the diameters of the rollers 17 and 18 are less than the spacing between the flanges or tracks. However, when the rock yoke 14 is oscillated about its pivot axle 16 in either direction away from its vertical dead center position, each of the rollers 17 and 18 will be brought into friction drive contact with one or the other of the flanges or tracks 7 and 8, depending upon the direction of oscillation of the rock yoke and, accordingly, the guide rolls 11 and 12 will be independently driven in opposite directions as the rock yokes are bodily traversed in one direction and the guide rolls 11 and 12 will continue to be driven in the same opposite directions when the rock yokes are bodily traversed in the opposite direction due to a reversal of the oscillation of the rock yokes which shifts the engagement of the rollers 17 and 18 to their opposite flanges or tracks.

The bodily traverse of the rock yokes and guide rolls and the oscillation of the rock yokes to shift the driven relation of the rollers 17 and 18 with respect to the flanges or tracks 7 and 8 is effected through an endless chain traverse drive that includes a pair of longitudinally disposed endless sprocket or roller chains 19, 19 carried by sprockets 20 rotatably mounted on the side frames 5 below the plane of the rock yoke pivot axles 16 so that the depending portions of the rock yokes may be slidably and pivotally connected to the chains 19 for oscillation and traverse.

For this latter purpose, each rock yoke 14 is provided with a centrally located vertical slot 21 (see FIGS. 2 and 3) which carries a vertically movable slide block 22 provided with a roller 23 rotatably mounted on a stub axle 24 extending from a special connecting link in its associated sprocket chain 19 as shown in FIG. 4 of the drawings.

The traverse chains 19 are driven from any suitable variable speed drive (not shown) through a transverse shaft 25 and sprockets and chains generally indicated 26.

A centrally located transverse horizontal draw roll 27 is disposed a substantial distance above the plane of the guide roll assembly 9 and is provided with a shaft 28 journalled in a pair of vertical standards 29,29 affixed to the side frames 5,5. The draw roll 27 is driven by any suitable variable speed drive (not sown) as by pulley and belt means generally indicated 30.

In operation, a fabric web 31 is withdrawn from a supply source over the draw roll 27 and downwardly between the rolls 10 and 11 of the guide roll assembly which is bodily traversed back and forth to cause the web to be deposited onto a table or into a receiver as a progressive series of zig-zag or fan folds.

Although it is believed that the operating principles of this folding machine will have been understood from the foregoing disclosure, a brief description of one cycle of operation now will be presented in order to make it clear just how the guide rolls 10 and 11 are independently driven in the same opposite directions regardless of the direction of traverse of the guide roll assembly 9.

Starting with the parts as shown in FIGS. 1–3 of the drawings, it will be seen that the traverse chains 19 are moving the guide roll assembly 9 from right to left by the roller axles 24 of the yoke slides 22 along the lower horizontal flights of the chains 19. In this condition, the rock yokes 14 have become slightly oscillated in a clockwise direction about their support rollers 15 so that the rollers 18 of the guide roll 11 have been brought into friction drive contact with the upper flanges or tracks 7 to rotate that guide roll in a clockwise direction. Simultaneously, the rollers 17 of the guide roll 10 have been brought into friction drive contact with the lower flanges or tracks 8 to rotate that guide roll in a counter-clockwise direction.

As the guide roll assembly 9 reaches the end of its right to left traverse, the roller axles 24 move around the associated end sprockets of the chain drive and proceed back from left to right along the horizontal upper flights of the chains 19, thus raising the slide blocks 22 to the upper position as shown in dotted lines in FIG. 3 and causing the rock yokes 14 to oscillate slightly in a counter-clockwise direction, thus shifting the rollers 17 and 18 into friction drive engagement with the opposites of the flanges or tracks 7 and 8, again driving the guide rolls 10 and 11 in the same opposite directions as the guide roll assembly is moved in its reverse direction of traverse, at the end of which the parts resume the positions as shown in FIGS. 2 and 3 of the drawings.

It will be understood that while the illustrated embodiment of the invention does not provide for any adjustment to the length of traverse of the guide roll assembly, such adjustment readily may be effected by changing the locations of the sprockets 20 and employing correspondingly longer or shorter endless traverse chains 19. If both end pairs of the sprockets 20 are relocated equally, the draw roll 27 will remain at the mid point of the traverse, otherwise if only one end pair of the sprockets 20 are relocated, a corresponding relocation of the draw roll should be made.

It is of course to be understood that variations in arrangements and proportions of parts may be made within the scope of the appended claims.

I claim:

1. A folder for a continually advancing fabric web and including a pair of horizontal longitudinally extending spaced parallel frame members each provided with a pair of vertically spaced upper and lower flanges, the flanges of one of said frame members being opposed to the flanges of the other thereof, a transverse guide roll assembly pivotally and reciprocably supported at each end by said lower flanges and including a pair of spaced parallel rotatable guide rolls, each of said guide rolls being mounted upon a shaft having each end extending into the space between the upper and lower flanges of its associated frame member, a drive roller affixed to the extending end of each said guide roll shaft and having a diameter to fit with clearance between the said associated upper and lower flanges; means for bodily reciprocating said guide roll assembly along the flanges of said frame members; and means associated with said reciprocating means for oscillating said guide roll assembly in one direction about its said pivotal support during one direction of bodily reciprocation of said guide roll assembly and for oscillating said guide roll assembly in an opposite direction during the opposite direction of bodily reciprocation of said guide roll assembly, whereby to cause said guide rolls to be frictionally driven in the same opposed directions regardless of the direction of bodily reciprocation of said guide roll assembly by alternating contact of said drive rollers with said upper and lower flanges; said means for bodily reciprocating said guide roll assembly and said oscillating means together comprising a pair of constantly driven endless traverse chains each provided with a laterally projecting stub axle affixed to a link thereof, and a pair of rock yoke and slide connections extending between the shafts of said guide rolls and said stub axles, said rock yokes each being provided with a freely rotatable roller engageable with an associated lower flange for pivotally supporting the associated end of said guide roll assembly, the axes of the shafts of said guide rolls lying in a horizontal plane above that containing the axis of said rock yoke rollers when said rock yokes are in a vertical dead center position, each of said rock yoke rollers being located intermediate the associated shaft rollers and disposed with its lower edge below the lower edges of said shaft rollers.

2. The folder of claim 1 additionally including a transverse horizontal draw roll rotatably mounted in a plane above that of said spaced parallel frame members, and means for driving said draw roll.

3. The folder of claim 2 in which said means for driving said draw roll is a variable speed drive.

4. The folder of claim 1 in which each of said rock yokes is provided with a generally vertical slideway having a slide block slidably mounted therein for reciprocatory motion with respect thereto, said slide block being pivotally connected to the stub axle of its associated traverse chain.

5. The folder of claim 1 in which said means for driving said endless traverse chains is a variable speed drive.

* * * * *